United States Patent [19]

Schulte

[11] Patent Number: 4,987,760

[45] Date of Patent: Jan. 29, 1991

[54] LEAF-SPRING BENDER

[75] Inventor: Helmut Schulte, Ennepetal-Voerde, Fed. Rep. of Germany

[73] Assignee: Luhn & Pulvermacher GmbH & Co., Haten, Fed. Rep. of Germany

[21] Appl. No.: 464,426

[22] Filed: Jan. 12, 1990

[30] Foreign Application Priority Data

Jan. 21, 1989 [DE] Fed. Rep. of Germany ..... 3901751

[51] Int. Cl.[5] ..... B21D 37/06

[52] U.S. Cl. ..... 72/306; 72/321; 72/323; 72/413

[58] Field of Search ..... 72/306, 323, 319–321, 72/413, 414; 29/173

[56] References Cited

U.S. PATENT DOCUMENTS

| | | | |
|---|---|---|---|
| 241,228 | 5/1881 | Letzkus | 72/413 |
| 242,569 | 6/1881 | Stevenson | 72/323 |
| 929,309 | 7/1909 | Johnson | 72/413 |

FOREIGN PATENT DOCUMENTS

| | | | |
|---|---|---|---|
| 607617 | 5/1978 | U.S.S.R. | 72/306 |
| 1324713 | 7/1987 | U.S.S.R. | 72/306 |
| 2767 | of 1872 | United Kingdom | 72/320 |
| 8622 | of 1901 | United Kingdom | 72/413 |

*Primary Examiner*—Daniel C. Crane

*Attorney, Agent, or Firm*—Herbert Dubno; Andrew Wilford

[57] ABSTRACT

An apparatus for bending a leaf spring from a generally straight into an arcuate shape has a frame and a lower jaw assembly on the frame including a fixed central jaw having a flat upper face and a pair of normally curved side jaws flanking the central jaw, each formed by a group of shape-defining fingers, and pivotal about an axis generally centrally between them between a position defining an angle of about 180° and a position defining an angle substantially smaller than 180°. An upper jaw assembly on the frame includes a vertically displaceable central jaw having a generally flat lower face above the lower central jaw, a pair of normally curved side jaws flanking the upper central jaw above the lower side jaws and each formed by a group of shape-defining fingers, and structure supporting the upper side jaws for angular movement about generally parallel axes adjacent the upper central jaw. Thus the upper side jaws can be positioned generally parallel to the lower side jaws. The upper central jaw can be displaced vertically down on the frame toward the lower central jaw and thereby clamping a middle of a generally straight workpiece blank between the faces and the upper side jaws can also be displaced on the frame toward the lower jaws to bend down ends of the workpiece clamped between the central jaws.

7 Claims, 2 Drawing Sheets

LEAF-SPRING BENDER

FIELD OF THE INVENTION

The present invention relates to an apparatus for making leaf springs. More particularly this invention concerns a device for bending leaf springs into an arcuate shape.

BACKGROUND OF THE INVENTION

An arcuate or parabolic leaf spring is made by bending a generally straight and flat leaf-spring blank to the desired arc and then heat treating it to stiffen it in this shape. This bending is typically done in a machine having a fixed jaw and a movable jaw, typically referred to as the lower and upper jaw, respectively, although the reverse orientation is perfectly possible. Each jaw is provided with a plurality of shape-defining fingers that can be moved so their ends form the desired shape and then locked in place, typically with a cam arrangement.

The spring blank is set on the lower jaw and the upper jaw is moved down atop it to bend the blank into the desired shape. Then the bent blank is passed through a hot bath to heat-treat it. Such a procedure is described in "Blattfedern biegen und härten in automatischen Anlagen" ("Leaf-spring bending and hardening in automatic machines" by Hans Hermann Kallenberg, special publication of Vogelverlag Wurzburg, 29th year, *Bander, Bleche, Rohre,* Feb. 1989).

Such arrangements are useful with standard relatively flat leaf springs, but are not capable of forming highly arced springs, for instance of semicircular shape, as are now frequently called for. Such springs must be produced in successive stages in successive pieces of equipment.

OBJECTS OF THE INVENTION

It is therefore an object of the present invention to provide an improved apparatus for bending leaf springs.

Another object is the provision of such an improved apparatus for bending leaf springs which overcomes the above-given disadvantages, that is which can form highly arced springs where one end can be in fact extending at about 90° to the opposite end.

SUMMARY OF THE INVENTION

An apparatus for bending a leaf spring from a generally straight into an arcuate shape according to the invention has a frame and a lower jaw assembly on the frame including a fixed central jaw having a flat upper face and a pair of normally curved side jaws flanking the central jaw, each formed by a group of shape-defining fingers, and pivotal about an axis generally centrally between them between a position defining an angle of about 180° and a position defining an angle substantially smaller than 180°. An upper jaw assembly on the frame includes a vertically displaceable central jaw having a generally flat lower face above the lower central jaw, a pair of normally curved side jaws flanking the upper central jaw above the lower side jaws and each formed by a group of shape-defining fingers, and structure supporting the upper side jaws for angular movement about generally parallel axes adjacent the upper central jaw. Thus the upper side jaws can be positioned generally parallel to the lower side jaws. The upper central jaw can be displaced vertically down on the frame toward the lower central jaw and thereby clamp a middle of a generally straight workpiece blank between the faces and the upper side jaws can also be displaced on the frame toward the lower jaws to bend down ends of the workpiece clamped between the central jaws.

Dividing each of the jaws into three parts makes it possible to bend a straight workpiece in one operation into a relatively deeply curved product with considerable precision. The method of this invention entails first clamping the middle of the blank, and then bending down both sides simultaneously to the desired shape. One end of a workpiece thus deformed can in fact extend at 90° to the opposite end.

According to another feature of this invention the upper-jaw displacing system includes respective hydraulic rams engaging the side upper jaws and the frame includes guides on which these rams are angularly displaceable into positions with the upper side jaws parallel to the respective lower side jaws. With this arrangement the side jaws on each side of the machine are positioned during setup so they extend parallel to each other. For the actual bending, the upper jaws are just moved in a straight line.

It is also possible according to this invention for the upper side jaws to be pivotal on the frame about respective axes 10 substantially parallel to the lower-jaw axis. In this case the apparatus includes respective hydraulic rams engaging the upper side jaws at locations offset from the respective axes. Thus here the upper side jaws are pivoted during a bending operation from a position extending at an angle of about 180° to each other to a position forming the same angle as the lower side jaws.

Furthermore according to the invention the frame has respective arcuate guides having centers of curvature at the lower-jaw axes and the lower jaws have outer ends guided in the respective guides. Each of the side jaws is formed with a slot in which the respective fingers are slidable and each side jaw has a device for clamping the respective fingers in the respective slot against movement therein. This allows the side jaws to be fitted to a spring template rather easily.

In accordance with further features of the invention the upper side jaws have downwardly directed abutments and the lower side jaws have upwardly directed abutments engageable with the abutments of the respective upper side jaws. Thus the upper side jaws are pushed down until the abutments meet, at which point the bending operation is complete.

DESCRIPTION OF THE DRAWING

The above and other objects, features, and advantages will become more readily apparent from the following, reference being made to the accompanying drawing in which.

SPECIFIC DESCRIPTION

Figure 1:
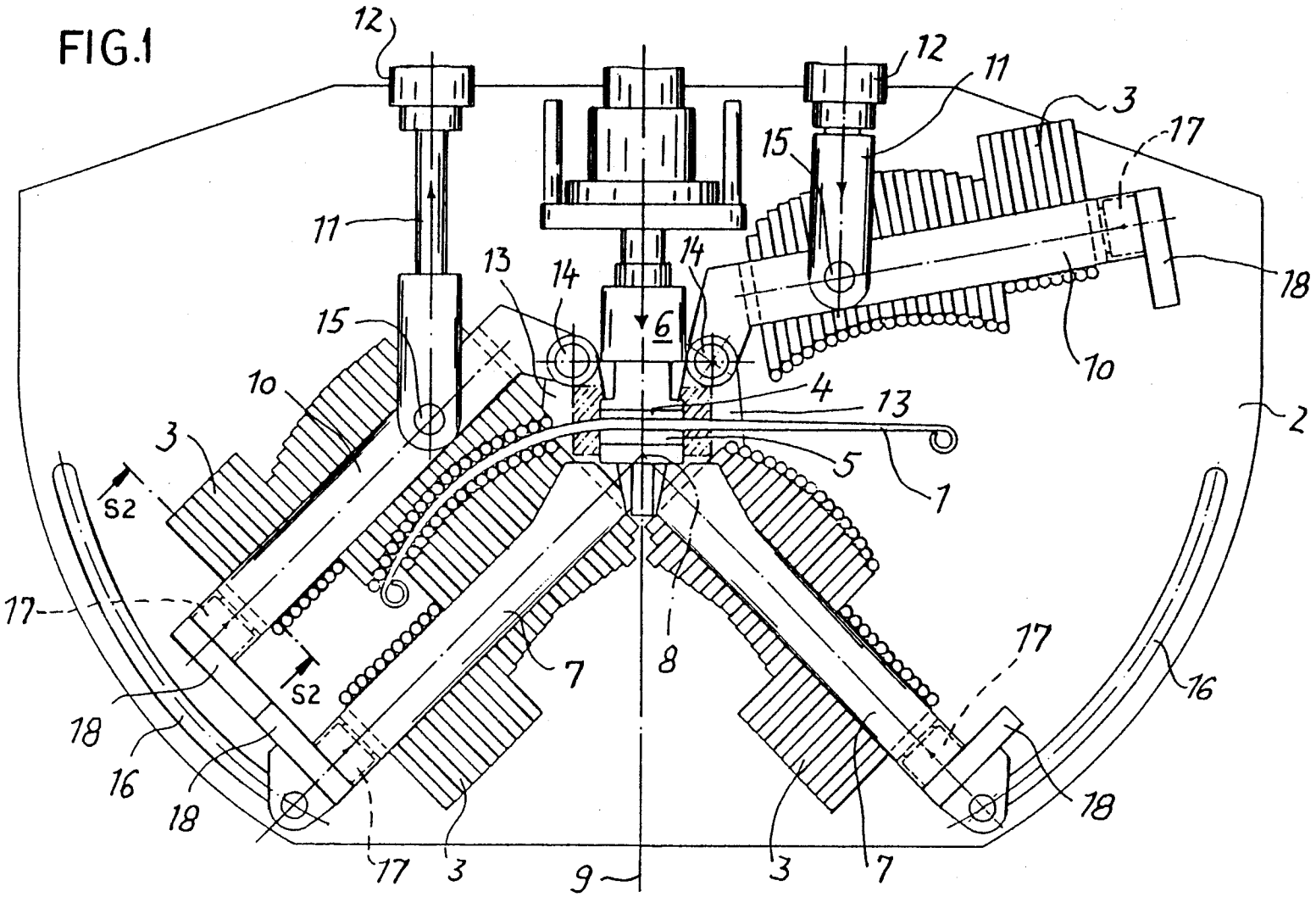
FIG. 1 is a partly diagrammatic vertical section through the apparatus according to this invention.
Figure 2:
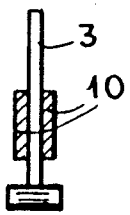
FIG. 2 is a section taken along line S2—S2 of FIG. 1.

As seen in FIGS. 1 and 2 a workpiece 1 is formed in an apparatus having a stationary frame 2 carrying an upper jaw assembly 4, 10 and a lower jaw assembly 4, 7. The apparatus is basically symmetrical to a vertical plane 9 and in fact operates symmetrically although for purposes of view the right-hand half of the apparatus is shown in FIG. 1 in a position different from that of the left-hand half.

The upper jaw assembly basically comprises a central jaw 4 having a flat lower face centered on the plane 9 and vertically displaceable by a hydraulic ram 6, and a pair of identical side jaws 10 each having a plurality of shape-defining fingers 3. The side jaws 10 have inner ends pivoted at 14 on supports 13 fixed on the frame 2, these pivots 14 being parallel and horizontal and symmetrically flanking the plane 9. The side jaws 10 are jointly displaced by heavy-duty hydraulic rams 12 having piston rods 11 pivoted at 15 on the jaws 10 offset outward from the axes 14. The upper ends of the rams 12 are pivoted on the frame 2 about axes parallel to the axes 14.

The lower jaw assembly comprises a stationary central jaw 5 having a horizontal upper face underneath the jaw 4, and two side jaws 7 basically constructed like the jaws 10 and pivoted at an axis 8 lying on the plane 9 underneath and parallel to the pivots 14. The jaws 7 have outer ends riding in arcuate guides 16 formed in the frame 2 and can be secured at any position therein. In the illustrated position they are at the bottom ends of the guides 16 and extend at an angle of 90° to each other, that is at 45° to the plane 9. If at the opposite upper ends of the guides 16 they would extend straight, that is at an angle of 180° to each other.

The outer ends of the jaws 7 and 10 carry engageable abutment blocks 18 that meet as shown on the left in FIG. 1 when they are closed together. In addition each jaw 7 and 19 carries a clamping cylinder 17 that can secure the respective shape-defining fingers 3 in place.

To set the machine up, a workpiece of the desired end shape is secured in the machine with its center clamped between the jaws 4 and 5, with the upper jaws 10 raised all the way up, the lower jaws 7 all the way down, and the cylinders 17 are all depressurized so the fingers 3 can slide easily in the respective slots.

The jaws 7 and 10 are then moved into positions generally parallel to the respective sides of the workpiece until the abutments 18 meet and then the lower jaws 7 are clamped in the guides 16. Then the fingers 3 are pressed in until they engage the workpiece, and then the cylinders 17 are pressurized to set their positions.

Thereafter a straight workpiece is bent by clamping its center between the jaws 4 and 5. Then the upper jaws 10 are pivoted down by the cylinders 12 until the abutments 18 meet, at which time the workpiece has been deformed in to the desired shape. The bent workpiece is then heat-treated.

Figure 3:
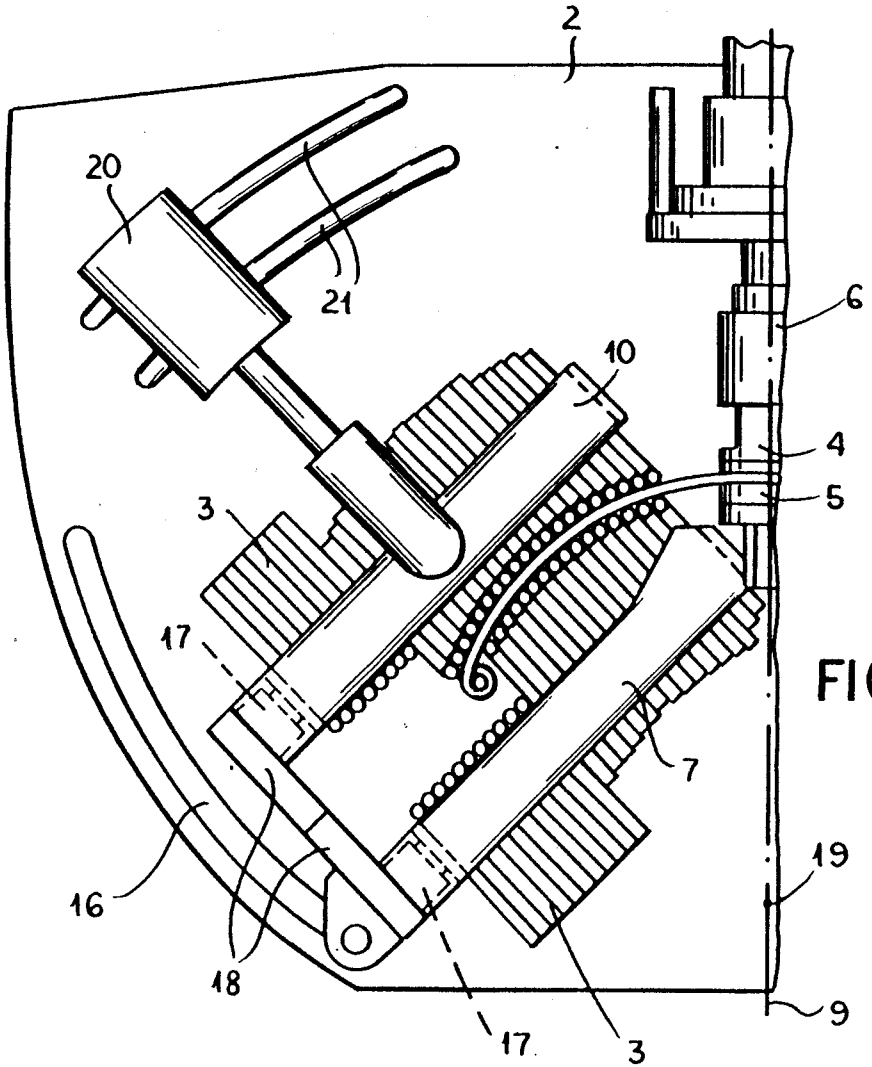
FIG. 3 is a view like a detail of FIG. 1 showing an alternative arrangement according to this invention.

In FIG. 3 the upper arms 10 are fixed on piston rods of cylinders 20 that are movable in arcuate guides 21 on the frame 2. The center of curvature of these guides 21 is at 19 on the symmetry plane 9. In this arrangement, which works basically the same as that of FIG. 1, the cylinders 20 are pivoted along the guides 21 during setup until the jaws 7 and 10 are parallel and the abutments 18 touch, and is clamped in this position. Thereafter the workpiece is bent by simply moving the jaws 10 in a straight line perpendicular to the lower jaws 7.

I claim:

1. An apparatus for bending a leaf spring from a generally straight into an arcuate shape, the apparatus comprising:

a frame;

a lower jaw assembly on the frame and including a fixed central jaw having a flat upper face, and a pair of normally curved side jaws flanking the central jaw, each formed by a group of shape-defining fingers, and pivotal about an axis generally centrally between them between a position defining an angle of about 180° and a position defining an angle substantially smaller than 180°;

an upper jaw assembly on the frame and including a vertically displaceable central jaw having a generally flat lower face above the lower central jaw, a pair of normally curved side jaws flanking the upper central jaw above the lower side jaws and each formed with a respective guide slot, a respective group of shape-defining fingers in each of the slots, means for clamping the fingers in the respective slot against movement therein, and means supporting the upper side jaws for angular movement about generally parallel axes adjacent the upper central jaw, whereby the upper side jaws can be positioned generally parallel to the lower side jaws; and means for vertically displacing the upper central jaw down on the frame toward the lower central jaw and thereby clamping a middle of a generally straight workpiece blank between the faces; and means for displacing the upper side jaws on the frame toward the lower jaws and thereby bending down ends of the workpiece clamped between the central jaws.

2. The bending apparatus defined in claim 1 wherein the upper-jaw pivot means includes respective hydraulic rams engaging the side upper jaws, the frame including guides on which the upper side jaws are angularly displaceable into positions parallel to the respective lower side jaws.

3. The bending apparatus defined in claim 1 wherein the upper side jaws are pivotal on the frame about respective axes substantially parallel to the lower-jaw axis, the apparatus including respective hydraulic rams engaging the upper side jaws at locations offset from the respective axes.

4. The bending apparatus defined in claim 1 wherein the frame has respective arcuate guides having centers of curvature at the lower-jaw axes, the lower jaws having outer ends guided in the respective guides.

5. The bending apparatus defined in claim 1 wherein the upper side jaws have downwardly directed abutments and the lower side jaws have upwardly directed abutments engageable with the abutments of the respective upper side jaws.

6. An apparatus for bending a leaf spring from a generally straight into an arcuate shape, the apparatus comprising:

a frame;

a lower jaw assembly on the frame and including a fixed central jaw having a flat upper face, and a pair of normally curved side jaws flanking the central jaw, each formed by a group of shape-defining fingers, and pivotal about an axis generally centrally between them between a position defining an angle of about 180° and a position defining an angle substantially smaller than 180°;

an upper jaw assembly on the frame and including a vertically displaceable central jaw having a generally flat lower face above the lower central jaw, a pair of normally curved side jaws flanking the upper central jaw above the lower side jaws and each formed with a respective guide slot, a respective group of shape-defining fingers in each of the slots, means for clamping the fingers in the respective slot against movement therein, and respective pivots supporting the upper side jaws on the frame for angular movement about generally parallel axes adjacent the upper central jaw, whereby the upper side jaws can be positioned generally parallel to the lower side jaws; and means for vertically displacing the upper central jaw down on the frame toward the lower central jaw and thereby clamping a middle of a generally straight workpiece blank between the faces; and means for pivoting the upper side jaws on the frame toward the lower jaws and thereby bending down ends of the workpiece clamped between the central jaws.

7. An apparatus for bending a leaf spring from a generally straight into an arcuate shape, the apparatus comprising:

a frame;

a lower jaw assembly on the frame and including a fixed central jaw having a flat upper face, and a pair of normally curved side jaws flanking the central jaw, each formed by a group of shape-defining fingers, and pivotal about an axis generally centrally between them between a position defining an angle of about 180° and a position defining an angle substantially smaller than 180°;

an upper jaw assembly on the frame and including a vertically displaceable central jaw having a generally flat lower face above the lower central jaw, a pair of normally curved side jaws flanking the upper central jaw above the lower side jaws and each formed with a respective guide slot, a respective group of shape-defining fingers in each of the slots, means for clamping the fingers in the respective slot against movement therein, and respective guides supporting the upper side jaws on the frame for angular movement about generally parallel axes adjacent the upper central jaw, whereby the upper side jaws can be positioned generally parallel to the lower side jaws; and means for vertically displacing the upper central jaw down on the frame toward the lower central jaw and thereby clamping a middle of a generally straight workpiece blank between the faces; and means for displacing the upper side jaws on the frame toward the lower jaws and thereby bending down ends of the workpiece clamped between the central jaws.

* * * * *